US008336170B2

(12) United States Patent
Wedegaertner

(10) Patent No.: US 8,336,170 B2
(45) Date of Patent: Dec. 25, 2012

(54) COTTONSEED DELINTERS AND METHODS

(75) Inventor: Thomas C. Wedegaertner, Raleigh, NC (US)

(73) Assignee: Cotton Incorporated, Cary, NC (US)

( * ) Notice: Subject to any disclaimer, the term of this patent is extended or adjusted under 35 U.S.C. 154(b) by 0 days.

(21) Appl. No.: 13/117,697

(22) Filed: May 27, 2011

(65) Prior Publication Data

US 2012/0297579 A1 Nov. 29, 2012

(51) Int. Cl.
*D01B 1/04* (2006.01)

(52) U.S. Cl. ..... 19/41

(58) Field of Classification Search ..... 19/40, 41; 99/262, 627, 630; 426/483
See application file for complete search history.

(56) References Cited

U.S. PATENT DOCUMENTS

| | | | | |
|---|---|---|---|---|
| 384,340 | A | 6/1888 | Weatherhead et al. | |
| 557,789 | A * | 4/1896 | Faulkner | 19/41 |
| 691,272 | A | 1/1902 | Kasmeier | |
| 986,415 | A * | 3/1911 | White | 19/41 |
| 1,038,927 | A * | 9/1912 | McCormick | 19/54 |
| 1,353,295 | A | 9/1920 | Voorhies | |
| 1,449,847 | A | 3/1923 | Voorhies | |
| 1,457,329 | A | 6/1923 | Voorhies | |
| 2,064,602 | A | 12/1936 | Harris | |
| 2,191,893 | A * | 2/1940 | Mcdonald et al. | 422/309 |
| 2,433,178 | A * | 12/1947 | Ware | 19/41 |
| 2,724,148 | A | 11/1955 | McMath | |
| 3,402,076 | A | 9/1968 | Johnson | |
| 3,484,904 | A | 12/1969 | Berriman et al. | |
| 3,805,332 | A | 4/1974 | Williams et al. | |
| 3,943,604 | A | 3/1976 | Harrington et al. | |
| 4,028,852 | A | 6/1977 | Harrington et al. | |
| 4,154,021 | A * | 5/1979 | Griffith et al. | 19/41 |
| 4,441,232 | A | 4/1984 | Underbrink et al. | |
| 4,520,529 | A | 6/1985 | Davis | |
| 4,942,643 | A | 7/1990 | Kincer et al. | |
| 4,967,448 | A | 11/1990 | Mizer | |
| 5,245,919 | A * | 9/1993 | Neidigh | 99/623 |
| 5,249,335 | A | 10/1993 | Jones | |
| 5,423,107 | A | 6/1995 | Thrash | |
| 6,776,087 | B1 * | 8/2004 | Amstad | 99/540 |
| 7,428,863 | B2 * | 9/2008 | Wallace | 99/625 |
| 2005/0082144 | A1 * | 4/2005 | Maupin et al. | 198/659 |
| 2005/0217076 | A1 * | 10/2005 | Gvili et al. | 19/40 |

FOREIGN PATENT DOCUMENTS

GB 1061462 A 3/1967

OTHER PUBLICATIONS

International Search Report and Written Opinion date mailed Jul. 23, 2012; PCT International Application No. PCT/US2012/038047.

* cited by examiner

*Primary Examiner* — Shaun R Hurley
(74) *Attorney, Agent, or Firm* — Patton Boggs LLP; Robert H. Johnston, III

(57) ABSTRACT

Systems and methods for removing linters from ginned cottonseeds are provided. The systems and methods involve rotating the cottonseeds in a rotatable drum having a plurality of longitudinal brushes. The centrifugal force created by the rotation of the drum and the plurality of longitudinal brushes urge the cottonseeds against an interior surface of the drum that is lined with a flexible abrasive member. In this way, work is performed that removes the linters from the cottonseeds. The linters are removed using reduced pressure and the processed seeds are removed. Other systems and methods are disclosed.

23 Claims, 6 Drawing Sheets

COTTONSEED DELINTERS AND METHODS

BACKGROUND

The present disclosure relates generally to processing cottonseeds, and more particularly, but not by way of limitation, to cottonseed delinters and methods.

Cotton is said to have been in use since prehistoric times and remains an important product in the world today for many purposes. Cotton grows in a cotton boll, which is a protective capsule, around the seeds of the cotton plant. With the Industrial Revolution, cotton began to be separated from the cottonseed with a cotton gin. Yet, after ginning the cottonseed, cotton linters (or cotton wool) remain on the cottonseed. Linters are fine, silky fibers that are typically less than ¼ of an inch (6.3 mm) or less than ⅛ of an inch (3 mm) long. Linters have a unique lumen and have many uses and potential uses. Linters are different than the longer staple lint and are not simply short pieces of residual staple lint.

SUMMARY

According to an illustrative embodiment, a method for removing linters from ginned cottonseeds includes placing the ginned cottonseeds in a cavity of a rotatable drum having a flexible abrasive member coupled to an interior of the rotatable drum; rotating the rotatable drum at a sufficient angular velocity such that the cottonseeds are urged against the flexible abrasive member by a centrifugal force; and using a plurality of longitudinal brushes to bias the cottonseeds against the flexible abrasive member. The linters are thereby removed from the cottonseeds over time. The method also includes applying reduced pressure to the cavity to remove the linters from the cavity and removing the processed cottonseeds from the cavity.

According to another illustrative embodiment, a system for removing linters from ginned cottonseeds includes a rotatable drum having an exterior surface and an interior surface. The interior surface of the rotatable drum defines, at least in part, a cavity. The cavity has a first longitudinal-end opening and a second longitudinal-end opening. The system further includes a flexible abrasive member coupled to and substantially covering the interior surface of the rotatable drum, a frame for rotatably supporting the rotatable drum, and a first rotation device operably coupled to the rotatable drum for rotating the rotatable drum relative to the frame in a first direction such that a centrifugal force urges the cottonseeds in the rotatable drum against the flexible abrasive member. The system further includes a first end plate substantially covering the first longitudinal-end opening of the cavity, a second end plate substantially covering the second longitudinal-end opening, a cottonseed-introduction aperture for introducing cottonseeds having linters into the cavity, and a plurality of longitudinal brushes. Each longitudinal brush of the plurality of longitudinal brushes is rotatably coupled to the first end plate and the second end plate. Each longitudinal brush has brush elements that are configured to bias the cottonseeds having linters against the flexible abrasive member on the interior surface of the rotatable drum. The system further includes a second rotation device operably coupled to at least one of the plurality of longitudinal brushes, for rotating the same in a second direction and a linter-removal aperture fluidly coupled to the cavity and to a reduced-pressure source for removing linters from the cavity. The system also includes a seed-removal conduit fluidly coupled to the cavity for removing the cottonseeds after delinting, i.e., the processed cottonseeds.

According to another illustrative embodiment, a method of manufacturing a system for removing linters from ginned cottonseeds includes forming a rotatable drum having an exterior surface and an interior surface. The interior surface defines, at least in part, a cavity. The cavity has a first longitudinal-end opening and a second longitudinal-end opening. The method further includes coupling a flexible abrasive member to the interior surface of the rotatable drum, rotatably coupling the rotatable drum to a frame, operably coupling a first rotation device to the rotatable drum for rotating the rotatable drum relative to the frame in a first direction such that a centrifugal force urges the cottonseeds in the rotatable drum against the flexible abrasive member, substantially covering the first longitudinal-end opening of the cavity with a first end plate, and substantially covering the second longitudinal-end opening with a second end plate. The method further includes forming a cottonseed-introduction aperture that is fluidly coupled to the cavity for introducing cottonseeds having linters into the cavity and disposing a plurality of longitudinal brushes in the cavity. Each longitudinal brush of the plurality of longitudinal brushes is rotatably coupled to the first end plate and the second end plate and each longitudinal brush has brush elements that are configured to bias the cottonseeds having linters against the flexible abrasive member on the interior surface of the rotatable drum. The method further includes operably coupling a second rotation device to at least one of the plurality of longitudinal brushes, for rotating the same in a second direction and fluidly coupling a linter-removal aperture to the cavity and to a reduced-pressure source for removing linters from the cavity. The method also involves fluidly coupling a seed-removal conduit to the cavity for removing the cottonseeds after delinting.

Other features and advantages of the illustrative embodiments will become apparent with reference to the drawings and detailed description that follow.

DETAILED DESCRIPTION OF ILLUSTRATIVE EMBODIMENTS

Figure 1:
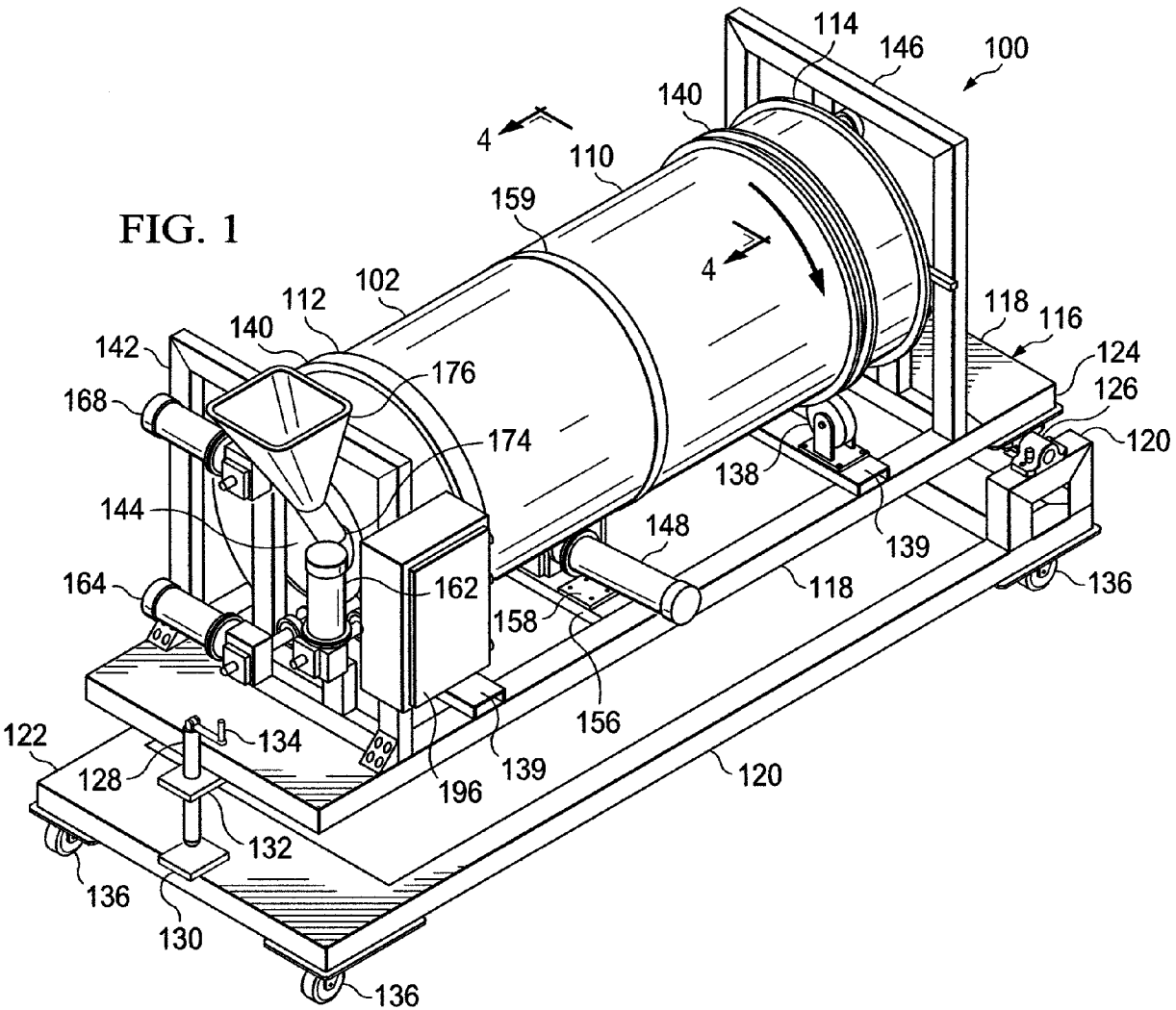
FIG. 1 is a schematic, perspective view of an illustrative system for delinting linters from a plurality of cottonseed.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Referring primarily to FIGS. 1-5, a system 100 for removing linters from ginned cottonseed 101 is presented. The system 100 removes linters and produces processed (or delinted) cottonseeds. The system 100 utilizes a rotatable drum 102 that receives the ginned cottonseeds into a cavity 104 in the rotatable drum 102. The rotation of the rotatable drum 102 causes the cottonseeds to impinge upon a flexible abrasive member 106 that is coupled to an interior surface 108 of the rotatable drum 102.

The rotatable drum 102 has an exterior surface 110, the interior surface 108, and an interior diameter, $D_1$. The rotatable drum 102 also has a longitudinal length that extends from a first longitudinal end 112 to a second longitudinal end 114. The rotatable drum 102 may have an aspect ratio (long dimension/diameter) in the range of 1 to 8. In one embodiment tested, the aspect ratio was approximately 2.6, but any number in the range given may be used and even outside the range in some embodiments. The rotatable drum 102 may be formed in any fashion to present a drum structure. In one embodiment, the rotatable drum 102 is formed as a rolled steel tube.

Figure 5:
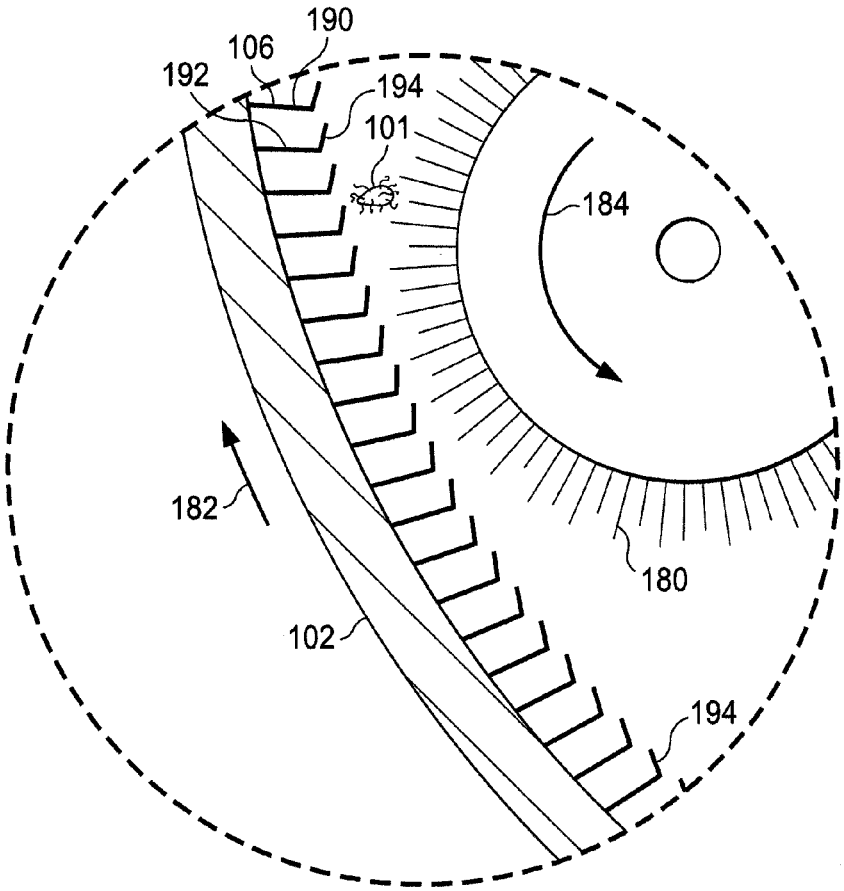
FIG. 5 is a detail of FIG. 4.

The interior surface 108 of the rotatable drum 102 is substantially covered by the flexible abrasive member 106, which may be a wire bristle brush or may be a card wire brush. The flexible abrasive member 106 may be coupled to the interior surface 108 of the rotatable drum 102 using an adhesive, epoxy, weld, UV weld, IR weld or any other attachment technique. The flexible abrasive member 106 and interior of the rotatable drum 102 could have mating slots to secure the flexible abrasive member 106 in the rotatable drum 102 and to facilitate removal and replacement. The flexible abrasive member 106 may be a card wire brush 190 having brush teeth 192, which have an angled portion 194. The angled portion 194 may angle in the same direction as the first direction 182 of rotation as shown in FIG. 5. The card wire brush 190 may be a cardwire brush of the type used in textile machines. The flexibility of the flexible abrasive member 106 may help to avoid damage to the cottonseed. The teeth on the card wire may be angled to grip the cottonseeds 101 and move them against gravity, i.e., up the drum wall (interior of the drum 102) for the orientation shown.

The system 100 includes a frame 116. The frame 116 may comprise a first frame 118 and a second frame 120. The frame 116 may have a first longitudinal end 122 and a second longitudinal end 124. A pivot connection 126 may be used to pivotally couple the first frame 118 and second frame 120 at second longitudinal end 124. A driving device 128, such as a jack or hydraulic lift, may be associated with the first frame 118 and second frame 120 at the first longitudinal end 122 of the frame 116 in order to create an angle between the first frame 118 and the second frame 120 about the pivot connection 126. The angle between the first frame 118 and the second frame 120 may be −5, −4, −3, −2, −1, 0, 1, 2, 3, 4, 5, 6, 7, 8, 9, 10, or more degrees.

The driving device 128 may include a platform 130 that is coupled to the second frame 120 and a second platform 132 associated with the first frame 118 whereby when a hand crank 134 or other activating device is used to cause the platforms 130 and 132 to move apart, it causes a greater space to develop between the first longitudinal end of each of the frames 118 and 120. The driving device 128 thus causes relative movement between the first longitudinal end of the first and second frames 118, 120. The frame 116 is shown on wheels or casters 136. The frame 116 also includes a plurality of rotatable supports 138. Typically, at least two rotatable supports 138 are included, one near the first longitudinal end 112 or near the second longitudinal end 114. The plurality of rotatable supports 138 may be displaced from one another and positioned to interface with one or more tracks 140 on the exterior 110 of the rotatable drum 102. The plurality of rotatable supports 138 may be mounted on lateral frame elements 139.

The frame 116 may further include a first longitudinal end frame 142. A first end plate 144 may be coupled to the first longitudinal end frame 142. The frame 116 may further include a second longitudinal end frame 146. A second end plate 145 is coupled to the second longitudinal end frame 146. As referenced below, bearing assembly and motors may be attached to the longitudinal end frames 142, 146. A control compartment 196 (FIG. 1) may be mounted on the longitudinal end frames 142 or 146 or elsewhere.

The control compartment 196 may include components for controlling the rotation devices 148, 162, 164, and 168. The control compartment 196 controls the rotation device 148 for the drum, which is run by a variable speed frequency drive, but does not necessarily need to be variable after the optimum is established. Also, rotation devices 164 and 162 may be consolidated into one motor that runs all the cleaning brushes. The rotation device 168, which turns the doffer brush, is also controlled by the control compartment 196. The driving device 128, if electrical, is also controlled at the control compartment 196.

An electrical motor or combustion engine, or other drive device, may function as a first rotation device 148. In the embodiment shown in FIG. 1, the first rotation device 148 comprises an electrical motor. The first rotation device 148 is operably coupled to a first drive assembly 150. The first drive assembly 150 may include a gear box 152 and rollers 154. The first drive assembly 150 may further include a drive belt 159 that extends around the exterior 110 of the rotatable drum 102. The first drive assembly 150 may be coupled to a lateral frame member 156 using securing plates 158. As shown best in FIG. 3, when the first rotation device 148 is activated, it turns a wheel 160 and causes the belt 159 to rotate. The belt 159 may be held in tension by the rollers 154. The first rotation device 148 is thus operably coupled to the rotatable drum 102 for rotating the rotatable drum 102 relative to the frame 116 in a first direction. While many approaches may be used for rotating the rotatable drum 102, the belt 159 secures the rotatable drum 102 and keeps the rotatable drum 102 from moving away from the rotatable supports 138.

The rotatable drum 102 rotates adequately to create a centrifugal force that urges the cottonseeds 101 with linters in the rotatable drum 102 against the flexible abrasive member 106. In one illustrative, embodiment, the first rotation device 148 is operable to rotate the rotatable drum 102 at a rotational speed greater than or equal to 170 revolutions per minute (RPM). For example, the first rotation device 148 may rotate the drum at 180 RPM, 170 RPM, 160 RPM, 150 RPM, 140 RPM, or another rotational speed. Whatever speed is selected should typically provide a centrifugal force to the cottonseed that urges the cottonseed against an interior of the drum and thereby against the flexible abrasive member 106. Other means of rotating the rotatable drum 102 may be implemented. The greater the rotational speed of the drum 102, the greater number of counter-rotating cleaning brushes 166.

In addition to securing the first end plate 144, the first longitudinal end frame 142 may also secure one or more rotation devices for rotating other components. For example, a second rotation device 162 and a third rotation device 164 may be coupled to the first longitudinal end frame 142. The second rotation device 162 and the third rotation device 164 may be used to rotate one or more of a plurality of longitudinal brushes 166 within the cavity 104. A fourth rotation device 168 may also be coupled to the first longitudinal end frame 142. The fourth rotation device 168 is operably coupled to rotate a doffer brush 170. Each longitudinal brush 166 may have a motor and could have a variable frequency drive to vary the speeds of each. The doffer brush 170 has a different drive device because the doffer brush 170 runs a different direction. Each drive device may have components associated with it to turn multiple longitudinal brushes 166.

Figure 6:
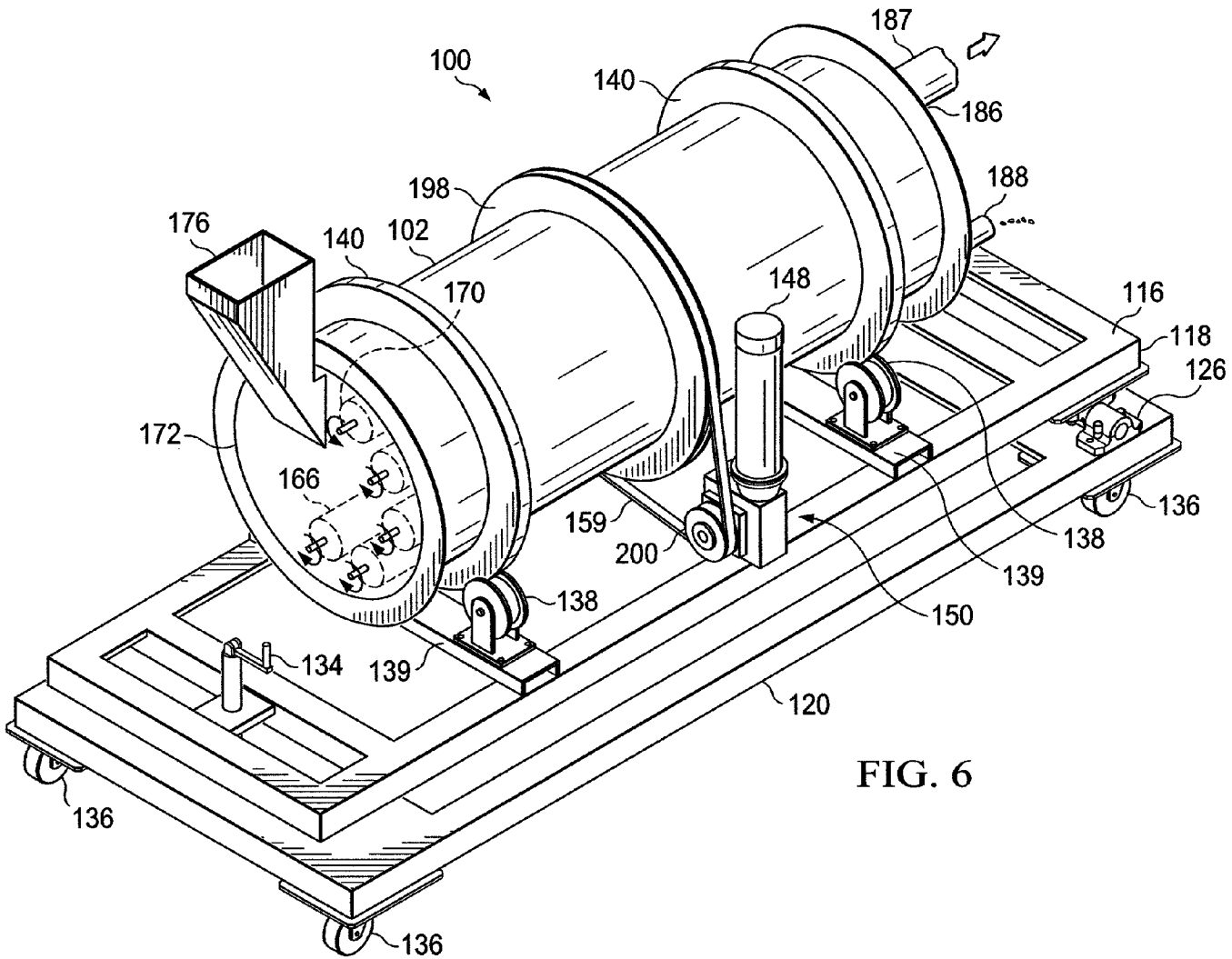
FIG. 6 is a schematic, perspective view, with a portion broken away, of another illustrative system for delinting linters from a plurality of cottonseed.

The first end plate 144 substantially covers a first longitudinal-end opening 172 (FIG. 6). Similarly, a second end plate 145 substantially covers a second longitudinal end opening of the cavity 104 (not shown but analogous to first longitudinal end opening 172). The first end plate 144 and second end plate may have bearings to rotatably suspend the plurality of longitudinal brushes 166 and the doffer brush 170. The end plates 144, 145 may include openings with seals, e.g., brush bristles, to help seal around the bearings or shafts of the longitudinal brushes 166 or doffer brush 170 that extend through the end plates 144, 145. In addition, belts, pulley, or gears may be coupled to the end plates 144, 145 to allow the rotation devices 162, 164, 168 to drive more than one brush or device. It will be appreciated that more or fewer rotation devices may be utilized depending on the number of belts or gears included. The longitudinal brushes 166 may rotate with speeds in the range of 40-800 RPM or any subset thereof.

A cottonseed-introduction aperture 174 is fluidly coupled to the cavity 104 for introducing ginned cottonseeds, which have linters, into the cavity 104. For example, the cottonseed-introduction aperture 174 may be formed on the first end plate 144. A seed funnel or hopper 176 may be operably coupled to the cottonseed-introduction aperture 174 to help deliver the ginned cottonseeds into the cavity 104. Alternatively, any suitable conveying device, such as a screw conveyor, could be used to introduce cottonseed into the cavity 104.

Figure 2:
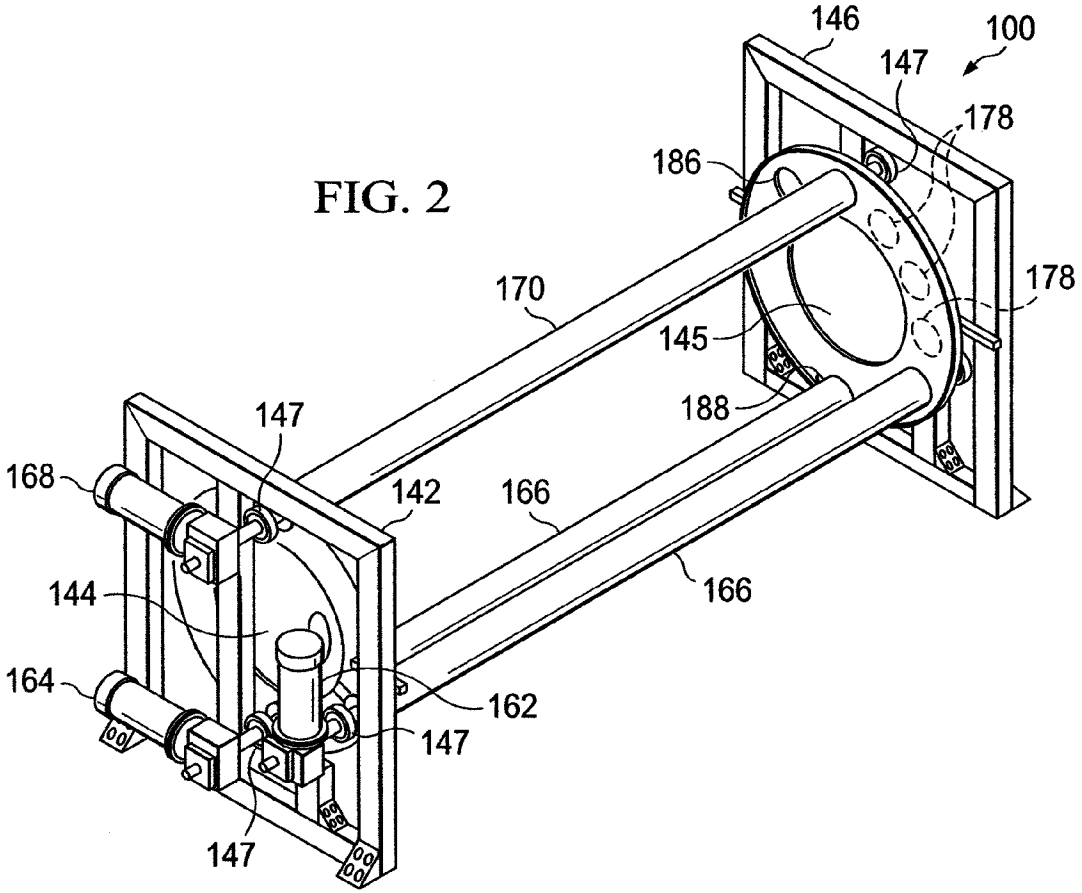
FIG. 2 is a schematic, perspective view of a portion of the system of FIG. 1 showing clearly the plurality of longitudinal brushes.
Figure 3:
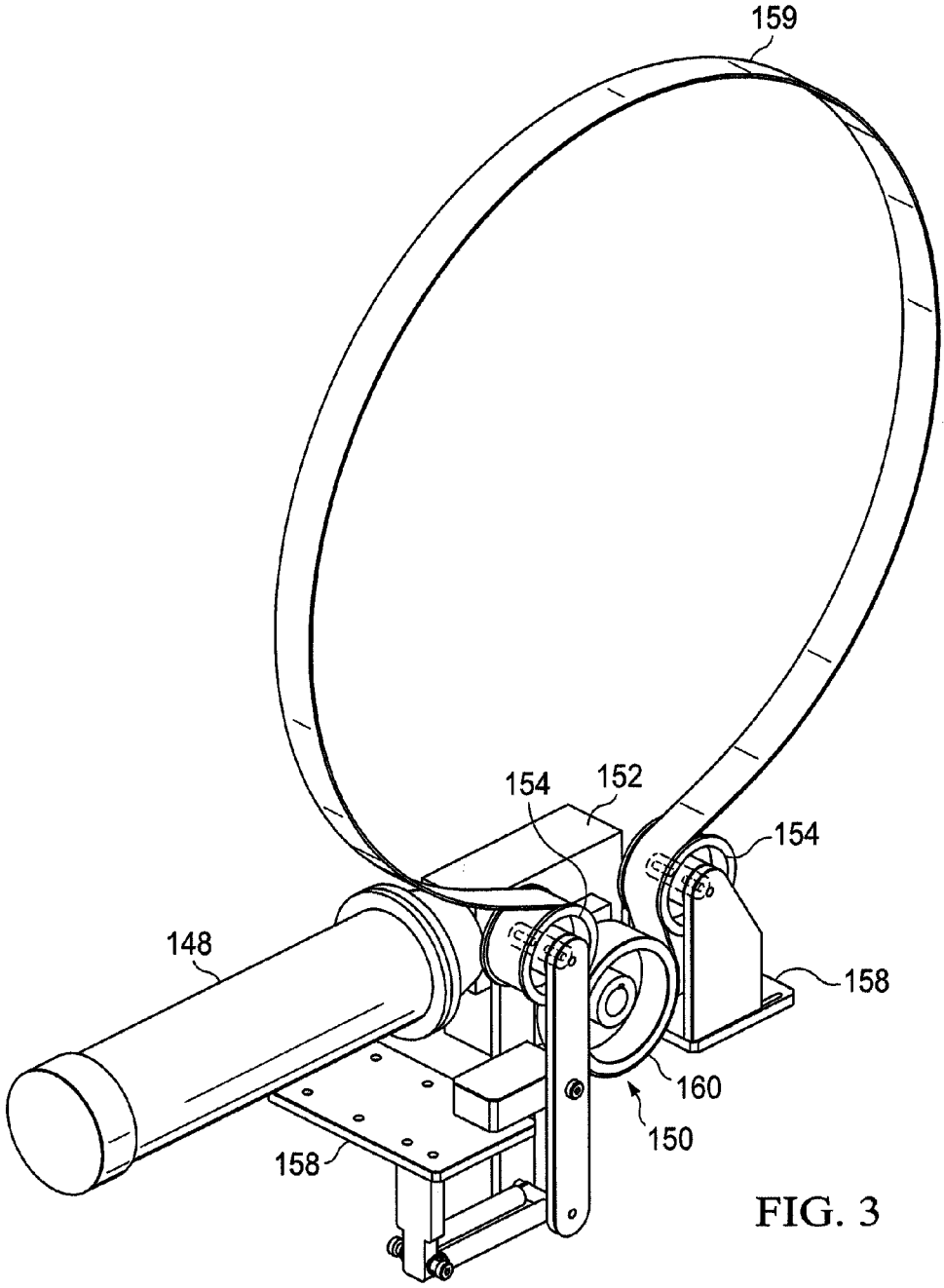
FIG. 3 is a schematic, perspective view of a portion of the system of FIG. 1 that causes the rotatable drum to rotate.

Referring now primarily to FIG. 2, a portion of the system 100 is shown with the rotatable drum 102 removed and the frame 116 removed along with associated components. Thus, the figure primarily shows the first longitudinal end frame 142 and the second longitudinal end frame 146 and the second end plate 145. The plurality of longitudinal brushes 166 are shown rotatably connected to the end plates 144, 145 with bearings 147. In addition, the doffer brush 170 is shown extending between the end plates 144, 145 and being supported by bearings 147. Thus, the longitudinal brushes 166 and doffer brush 170 may be rotatably suspended by the bearings 147. Broken lines 178 show the location of optional members of the plurality of longitudinal brushes 166. The plurality of longitudinal brushes 166 may extend from approximately six o'clock to twelve o'clock in the cavity 104 or any portion thereof. Typically, the longitudinal brushes 166 extend from a lowest point with respect to the gravity field to at or near the highest point with respect to the gravity filed. Typically, at least 90 degrees of the cross sectional interior of the rotation drum 102 is covered by the longitudinal brushes 166.

While the doffer brush 170 may be located at other locations, the doffer brush 170 is shown at or near the most vertical position with respect to the gravity field, i.e., twelve o'clock in the cavity 104. The doffer brush 170 may also be at one o'clock or two o'clock or another location near an upper portion of the cavity 104. The longitudinal doffer brush 170 may be positioned approximately 0.5 centimeters beyond the tip of the flexible abrasive member 106. That is, for example, the tips of the doffer brush 170 may protrude into the card wire brush 106 past the tips so as to clean the card wire brush 106 and remove linters. The doffer brush 170 is operable to remove linters and other debris that may be caught within the flexible abrasive member 106. The fourth rotation device 168 may rotate the doffer brush 170 in the first direction 182, which is the same direction as the rotatable drum 102. Typically, the doffer brush 170 is rotated at a speed greater than the rotatable drum 102, e.g., at least two times or at least three times the angular speed of the rotatable drum 102. In some embodiments, the doffer brush 170 may be omitted.

In another embodiment, the doffer brush 170 may be coupled at a top portion (e.g., 11, 12, or 1 o'clock) in the cavity 104 and may be substantially enclosed by a trough (not shown). The trough prevents seeds from going against the doffer brush 170 but allows the flexible abrasive member 106 to enter the trough and come into contact with the doffer brush 170. The doffer brush 170 removes the linters from the flexible abrasive member 106. The extended conduit 187 for removing linters may be in the cavity 104 proximate to the trough and may remove linters pulled from the flexible abrasive member 106.

Figure 4:
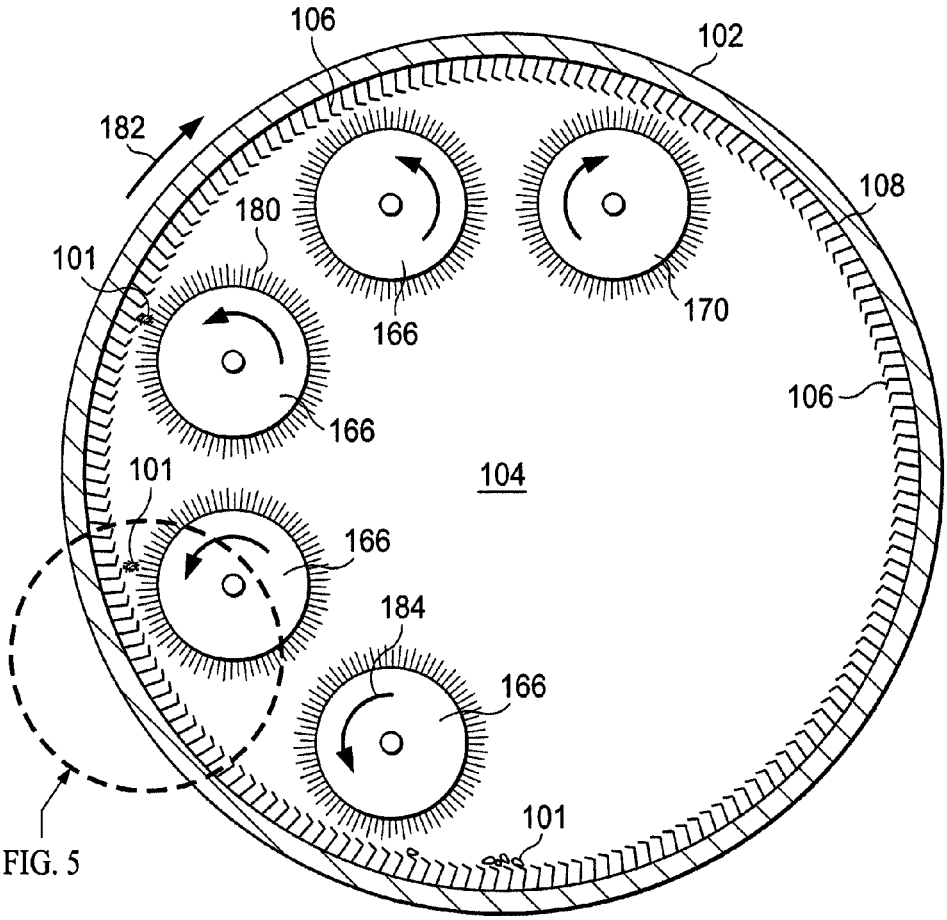
FIG. 4 is a schematic, cross-sectional view of the rotatable drum in FIG. 1 taken along line 4-4.

Each of the plurality of longitudinal brushes 166, as well as the doffer brush 170, is rotatably coupled to the first end plate 144 and the second end plate 145 with the bearings 147. One or more of the rotation devices 162, 164 are operable to rotate the plurality of longitudinal brushes 166 in a first or second direction, e.g., counter-clockwise. As shown in FIGS. 4 and 5, the plurality of longitudinal brushes 166 are positioned within cavity 104 such that brush elements 180 bias the cottonseeds 101 against the flexible abrasive member 106. Each longitudinal brush roller may rotate in a second direction 184 that is opposite to the first direction 182 of the rotatable drum 102.

The plurality of longitudinal brushes 166 may substantially cover the entire interior of the drum 102 except for the location of the doffer brush 170. Alternatively, the plurality of brushes 166 may cover only a portion of the interior of the drum 102. For example, the plurality of longitudinal brushes 166 may cover at least 90 degrees of the inside of the drum or the interior surface of the rotatable drum 102 beginning at a lowest point within the cavity 104 relative to a gravity field and spaced along the interior of the drum 102 in the direction of rotation of the rotatable drum 102. The plurality of longitudinal brushes 166 may all have the same inside diameter, $D_2$, or may have varying diameters, e.g., $D_3$, $D_4$, $D_5$, etc. In many embodiments, $D_2 < \frac{1}{4} D_1$, or $D_2 < \frac{1}{8} D_1$.

The second end plate 145 is formed with a linter-removal aperture 186 that is operably coupled to the cavity 104. The linter removal aperture 186 may receive reduced pressure from a vacuum source for removing linters from within the cavity 104. While not shown, the first end plate 144 may include a second linter-removal aperture to which a reduced-pressure source may be fluidly coupled. Thus, in some embodiment, linters may be removed at both ends. A conduit 187 is coupled to the linter removal aperture 186 and to the reduced pressure source. The conduit 187 may extend into the cavity 104 and may run the length of the cavity 104 or some portion and may have apertures in the portion in the cavity. In this way, linters may be drawn into the conduit 187 from multiple locations within the cavity 104.

The second end plate 145 is also formed with a seed-removal conduit or aperture 188 fluidly coupled to the cavity 104 for removing the cottonseeds after delinting. The aperture 188 may have a valve or be configured to be opened only at discrete times. The seed-removal aperture 188 may optionally have a gate or valve (not explicitly shown) for controlling the removal of cottonseeds from the cavity 104. In this way, the cottonseeds 101 may be batched processed before the gate is opened to remove the cottonseeds. The cottonseed-introduction aperture 174 may be sized such that under reduced pressure delivered through the linter removal aperture 186, a reduced pressure is maintained within the cavity 104 that is greater than a minus 100 millimeters of mercury. In any event, an air flow is established from within the cavity and the seed-removal conduit 188 that is adequate to carry (suspend) the linters and slow enough not to carry the cottonseed. For example, without limitation, the airflow established may be −400 CFM to −1000 CFM.

Referring now generally to FIGS. 1-5, in operation according to one illustrative embodiment, the system 100 is activated such that the rotatable drum 102 is rotated with a speed between 60 and 170 RPM (although other speeds are possible as described herein). Ginned cottonseeds are introduced into the hopper 176 and thereby introduced into the cavity 104. The centrifugal force caused by the rotatable drum 102 acting on the ginned cottonseeds along with the longitudinal brushes 166 causes the cottonseeds to be worked upon.

When operating, the cottonseeds bounce around—looking somewhat like popcorn—as the seeds continue to climb the drum wall but then fall again to repeat the process. Cottonseeds fly out of longitudinal brushes 166 or come out the top near the duffer brush 170. The cottonseeds go in one end, e.g., first end 112, and out the other in a main embodiment. The centrifugal force holds or helps hold the cottonseeds with linters against the inside of the rotatable drum 102 so that the work can be accomplished that removes the linters. The work is accomplished by an abrasive surface of the flexible abrasive member 106 as the centrifugal force and the longitudinal brushes 166 urge the cottonseed against the flexible abrasive member 106. The cottonseed is moved against the gravity field by the rotation of the rotatable drum 102. The heat generated by this process is relatively less than many mechanical approaches and is easily maintained at less than 150° Fahrenheit and more typically less than 140° Fahrenheit. If the seed is to be used for purposes other than planting, the temperature may be allowed to go higher than 140° F.

When finished, the ginned cottonseeds may have all the linters removed and look as if the cottonseeds have been acid-delinted, i.e., smooth and black. But, because the cottonseeds have not been acid delinted, the processed cottonseeds may be stored relatively longer than acid-delinted cottonseeds. The processed cottonseeds may also be useful for food applications.

Referring now primarily to FIG. 6, another illustrative embodiment of a system 100 for removing linters from ginned cottonseeds is presented. The system 100 is analogous to the system 100 of FIGS. 1-5, except the end frames 142 and 146 have been removed (for demonstration purposes), a belt track 198 has been added, and the first rotation device 148 and first drive assembly 150 are slightly different. In this embodiment, the first rotation device 148 is oriented vertically or lined parallel with the gravity field. The first drive assembly 150 includes a single drive wheel 200 that engages the belt 159.

Many alternatives and additions to system 100 of FIGS. 1-6 are possible. In some embodiments, replacement of the flexible abrasive member 106 may be facilitated. For example, the end plates 144, 145 may be removable so that the flexible abrasive member 106 may be removed. A new flexible abrasive member 106 may be slid into the rotatable drum 102 and attached. The end plates 144 or 145 may then be restored to their initial position.

In another alternative embodiment, a positive air stream impinges on the cottonseeds such that "naked" or processed cottonseeds (no linters) can go by the air stream but the cottonseeds with linters cannot. The air stream is set such that the air stream develops a force on the cottonseeds having linters that removes them from the exit path. The cottonseeds without linters continue along the exit path. This allows for a continuous feed and a continuous removal from the system 100.

In another illustrative embodiment, the entry of cottonseeds into the cavity 104 through the hopper 176 is regulated, but continuous. The angle of the rotatable drum 102 with respect to the frame 116 may be varied to control the general rate of movement of the cottonseeds through the cavity 104. The exit to the seed-removal conduit or aperture 188 may be regulated to only receive cottonseeds that have been delinted by using an air stream as previously described. After passing the regulated exit, the processed cottonseeds may still contain waste, e.g., pieces of stem, leaf, carpel, boll and other non-cottonseed material that remains with the seed after ginning. A second separator (air steam device) may be used to remove such waste.

In still another embodiment, the rotatable drum 102 has a longitudinal hinge (not shown) and a fastened portion to form a clam-like structure that is moveable between a closed position and open position. When one desires to gain access to the cavity 104 to replace the flexible abrasive member 106, the fastened portion is released, i.e., one or more fasteners are released, and the rotatable drum 102 opens about the longitudinal hinge to the opened position. In this way, the flexible abrasive member 106 may be replaced or cleaned. This embodiment, may be particularly attractive in a small table-top embodiment of the system 100 for use with seeds for planting since a cleaning or replacement of the flexible abrasive member 106 would typically be required between every batch. It should be noted that the systems 100 herein may be scaled for a table-top size to a large industrial gin size.

In another embodiment, one of the end plates 144, 145 may be hinged or removed to gain access to the cavity 104. This may require removing the bearings 147 associated with the longitudinal brushes 166 and the doffer brush 170. In another embodiment, an access door (not shown) may be on at least one of end plates 144, 145 and the flexible abrasive member 106 may have channels and the rotatable drum 102 grooves (or vice versa) that interface and allow the flexible abrasive member 106 to be slid out of the rotatable drum 102 for replacement.

In one particular embodiment that was tested in part, the rotatable drum 102 had a longitudinal length of approximately 93 inches and an inside diameter of approximately 36 inches. Thus, the aspect ration was approximately 2.58. The doffer brush 170 had an outside diameter of approximately 4.8 inches. The longitudinal brushes 166 were uniform and had an outside diameter of approximately 4.7 inches. The first rotation device 148 was a five horsepower electric motor used to turn the rotatable drum 102 in a first direction (e.g., clockwise). The second rotation device 162 was a three horsepower electric motor that had belts and pulleys associated with it to turn the plurality of longitudinal brushes 166 in a second direction (counter-clockwise). The fourth rotation device 168 was a three horsepower electric motor used to turn the doffer brush 170 in the first direction (e.g., clockwise). This system 100 was operable to fully process ginned cottonseeds in batches in ten minutes with typically 20 pounds of seeds being, processed. The system 100 was able to process between 100 and 150 pounds of ginned cottonseeds an hour. In another embodiment, the dimensions were the same, but ¾ horsepower motors were associated as the driving devices with each longitudinal brush 166.

In one embodiment, the seed-removal conduit 188 has a gate or valve for controlling or regulating the removal of cottonseeds 101 from the cavity 104 and the cottonseed-introduction aperture 174 is sized such that under reduced-pressure from the linter-removal aperture 186, a reduced-pressure is maintained in the cavity 104 that is greater than −100 mm Hg.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems.

It will be understood that the above description of preferred embodiments is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A system for removing linters from ginned cottonseeds, the system comprising:

a rotatable drum having an exterior surface and an interior surface, wherein the interior surface defines, at least in part, a cavity, wherein the cavity has a first longitudinal-end opening and a second longitudinal-end opening;

a flexible abrasive member coupled to and substantially covering the interior surface of the rotatable drum;

a frame for rotatably supporting the rotatable drum;

a first rotation device operably coupled to the rotatable drum for rotating the rotatable drum relative to the frame in a first direction such that a centrifugal force urges the cottonseeds in the rotatable drum against the flexible abrasive member;

a first end plate substantially covering the first longitudinal-end opening of the cavity;

a second end plate substantially covering the second longitudinal-end opening, a cottonseed-introduction aperture fluidly coupled to the cavity for introducing cottonseeds having linters into the cavity;

a plurality of longitudinal brushes, each longitudinal brush of the plurality of longitudinal brushes is rotatably coupled to the first end plate and the second end plate and each longitudinal brush has brush elements that are configured to bias the cottonseeds having linters against the flexible abrasive member on the interior surface of the rotatable drum;

a second rotation device operably coupled to at least one of the plurality of longitudinal brushes, for rotating the at least one of the longitudinal brushes in a second direction;

a linter-removal aperture fluidly coupled to the cavity and to a reduced-pressure source for removing linters from the cavity; and a seed-removal conduit fluidly coupled to the cavity for removing the cottonseeds after delinting.

2. The system for removing linters from a ginned cottonseed of claim 1, wherein the first rotation device is operable to rotate the rotatable drum at a rotational speed greater than or equal to 100 revolutions per minute (RPM).

3. The system for removing linters from a ginned cottonseed of claim 1, wherein the first rotation device is operable to rotate the rotatable drum at a rotational speed greater than or equal to 150 revolutions per minute (RPM).

4. The system for removing linters from a ginned cottonseed of claim 1, wherein the rotatable drum has an aspect ratio greater than or equal to two.

5. The system for removing linters from a ginned cottonseed of claim 1, further comprising:

a longitudinal doffer brush rotatably coupled to the first end plate and the second end plate and positioned to be in contact with the flexible abrasive member on the interior surface of the rotatable drum; and a third rotation device coupled to the longitudinal doffer brush causing the longitudinal doffer brush to rotate in the first direction with a speed greater than at least twice the rotatable drum speed, whereby the doffer brush removes linters clinging to the flexible abrasive member.

6. The system for removing linters from a ginned cottonseed of claim 5, further comprising a trough at least partially enclosing the doffer brush with a clearance from the rotatable drum such that cottonseeds cannot enter the trough.

7. The system for removing linters from a ginned cottonseed of claim 1, wherein the frame comprises an upper frame and a lower frame, the first frame and second frame each having a first longitudinal end and a second longitudinal end, and wherein the first longitudinal end of first frame and the second frame are pivotally coupled, and further comprising a drive device for causing relative movement between the second longitudinal end of the first frame and the second longitudinal end of the second frame to thereby form a frame angle.

8. The system for removing linters from a ginned cottonseed of claim 7, wherein the frame angle is greater than 5 degrees.

9. The system for removing linters from a ginned cottonseed of claim 7, wherein the frame angle is in the range of 1 to 10 degrees.

10. The system for removing linters from a ginned cottonseed of claim 7, wherein the frame angle is at least −2 degrees.

11. The system for removing linters from a ginned cottonseed of claim 1, wherein the flexible abrasive member comprises a card wire brush having brush teeth with an angled portion that is angled in the same direction as the first direction of rotation.

12. The system for removing linters from a ginned cottonseed of claim 1, wherein the plurality of longitudinal brushes substantially cover at least 90 degrees (in cross section) of the inside of the rotatable drum beginning at a lowest point within the cavity relative to a gravity field and spaced along the interior of the rotatable drum in the direction of rotation of the rotatable drum.

13. The system for removing linters from a ginned cottonseed of claim 1, wherein the seed-removal conduit has a gate for controlled removal of cottonseeds from the cavity and wherein the cottonseed-introduction aperture is sized such that under reduced-pressure from the linter-removal aperture, a reduced-pressure is maintained in the cavity that is greater than −100 mm Hg.

14. The system for removing linters from a ginned cottonseed of claim 1, further comprising:

a longitudinal doffer brush rotatably coupled to the first end plate and the second end plate and positioned to be in contact with the flexible abrasive member on the interior surface of the rotatable drum;

a third rotation device coupled to the longitudinal doffer brush causing the longitudinal doffer brush to rotate in the first direction with a speed greater than at least twice the rotatable drum speed, whereby the doffer brush removes linters clinging to the flexible abrasive member;

wherein the first rotation device is operable to rotate the rotatable drum at a rotational speed greater than or equal to 100 revolutions per minute (RPM);

wherein the frame comprises an upper frame and a lower frame, the first frame and second frame each having a first longitudinal end and a second longitudinal end, and wherein the first longitudinal end of first frame and the second frame are pivotally coupled, and further comprising a drive device for causing relative movement between the second longitudinal end of the first frame and the second longitudinal end of the second frame to thereby form a frame angle;

wherein the flexible abrasive member comprises a card wire brush having brush teeth with an angled portion that angle away from the first direction of rotation;

wherein the plurality of longitudinal brushes substantially cover at least 90 degrees of the inside of the rotatable drum beginning at a lowest point within the cavity relative to a gravity field and spaced along the interior of the rotatable drum in the direction of rotation of the rotatable drum; and wherein the seed-removal conduit has a gate for controlled removal of cottonseeds from the cavity and wherein the cottonseed-introduction aperture is sized such that under reduced-pressure from the linter-removal aperture, a reduced-pressure is maintained in the cavity that is greater than −100 mm Hg.

15. A method for removing linters from ginned cottonseeds, the method comprising the steps of:

placing the ginned cottonseeds in a cavity of a rotatable drum having a flexible abrasive member coupled to an interior of the rotatable drum;

rotating the rotatable drum at a sufficient angular velocity such that the cottonseeds are urged against the flexible abrasive member by a centrifugal force;

using a plurality of longitudinal brushes to bias the cottonseeds against the flexible abrasive member;

whereby the linters are removed from the cottonseeds;

applying reduced pressure to the cavity to remove the linters from the cavity; and removing the cottonseeds from the cavity.

16. The method of claim 15, further comprising batch processing the ginned cottonseeds.

17. The method of claim 15, further comprising performing a continuous processing of cottonseeds.

18. The method of claim 15, wherein the flexible abrasive member comprises a card wire brush.

19. The method of claim 15, wherein the step of rotating the rotatable drum comprises rotating the rotatable drum at an angular speed greater than 100 revolutions per minute.

20. The method of claim 15, further comprising applying an angle to the rotatable drum with respect to its longitudinal axis and a gravity field such that cottonseeds are urged to travel along the interior of the cavity from a first longitudinal end to a second longitudinal end.

21. A method of manufacturing a system for removing linters from ginned cottonseeds, the method comprising:

forming a rotatable drum having an exterior surface and an interior surface, wherein the interior surface defines, at least in part, a cavity, wherein the cavity has a first longitudinal-end opening and a second longitudinal-end opening;

coupling a flexible abrasive member to the interior surface of the rotatable drum;

rotatably coupling the rotatable drum to a frame;

operably coupling a first rotation device to the rotatable drum for rotating the rotatable drum relative to the frame in a first direction such that a centrifugal force urges the cottonseeds in the rotatable drum against the flexible abrasive member;

substantially covering the first longitudinal-end opening of the cavity with a first end plate;

substantially covering the second longitudinal-end opening with a second end plate;

forming a cottonseed-introduction aperture that is fluidly coupled to the cavity for introducing cottonseeds having linters into the cavity;

disposing a plurality of longitudinal brushes in the cavity, each longitudinal brush of the plurality of longitudinal brushes is rotatably coupled to the first end plate and the second end plate and each longitudinal brush has brush elements that are configured to bias the cottonseeds having linters against the flexible abrasive member on the interior surface of the rotatable drum;

operably coupling a second rotation device to at least one of the plurality of longitudinal brushes, for rotating the at least one of the longitudinal brushes in a second direction;

fluidly coupling a linter-removal aperture to the cavity and to a reduced-pressure source for removing linters from the cavity; and fluidly coupling a seed-removal conduit to the cavity for removing the cottonseeds after delinting.

22. The method of manufacturing a system of claim 21, wherein the rotatable drum has an aspect ratio greater than or equal to two.

23. The method of manufacturing a system of claim 21, further comprising:

disposing a longitudinal doffer brush in the cavity and rotatably coupling the doffer brush to the first end plate and the second end plate and positioned to be in contact with the flexible abrasive member on the interior surface of the rotatable drum; and operably coupling a third rotation device to the longitudinal doffer brush causing the longitudinal doffer brush to rotate in the first direction with a speed greater than at least twice the rotatable drum speed, whereby the doffer brush removes linters clinging to the flexible abrasive member.

* * * * *